US006760962B2

(12) United States Patent
Seamons

(10) Patent No.: US 6,760,962 B2
(45) Date of Patent: Jul. 13, 2004

(54) HYDRAULIC DECK CRIMPER

(75) Inventor: Jason Seamons, San Pablo, CA (US)

(73) Assignee: Jason Proffitt, North Pole, AK (US)

( * ) Notice: Subject to any disclaimer, the term of this patent is extended or adjusted under 35 U.S.C. 154(b) by 18 days.

(21) Appl. No.: 10/144,525

(22) Filed: May 14, 2002

(65) Prior Publication Data

US 2003/0213112 A1 Nov. 20, 2003

(51) Int. Cl.[7] ..... B23P 17/00

(52) U.S. Cl. ..... 29/243.5; 29/243.58; 29/293.57; 72/48

(58) Field of Search ..... 29/243.5, 243.58, 29/293.57; 72/48, 121, DIG. 1, 210, 298

(56) References Cited

U.S. PATENT DOCUMENTS

| | | | | | |
|---|---|---|---|---|---|
| 4,027,611 | A | * | 6/1977 | Ward et al. | 29/243.5 |
| 4,072,118 | A | * | 2/1978 | Schultheiss | 72/48 |
| 4,372,022 | A | * | 2/1983 | Puckett | 29/243.58 |
| 4,918,797 | A | * | 4/1990 | Watkins et al. | 29/243.5 |
| 5,623,805 | A | * | 4/1997 | Morello | 52/749.1 |
| 6,115,899 | A | * | 9/2000 | Rider | 29/243.5 |

* cited by examiner

*Primary Examiner*—Joseph J. Hail, III
*Assistant Examiner*—Daniel Shanley

(57) ABSTRACT

A hydraulic deck crimper for securing adjacent panels of a steel deck together and including a wheeled support structure and spaced apart depending pinch clamps operated by hydraulic cylinders to pinch mating flanges of adjacent panels that form a locking seam securely together.

6 Claims, 5 Drawing Sheets

HYDRAULIC DECK CRIMPER

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

FIELD OF THE INVENTION

Figure 1:
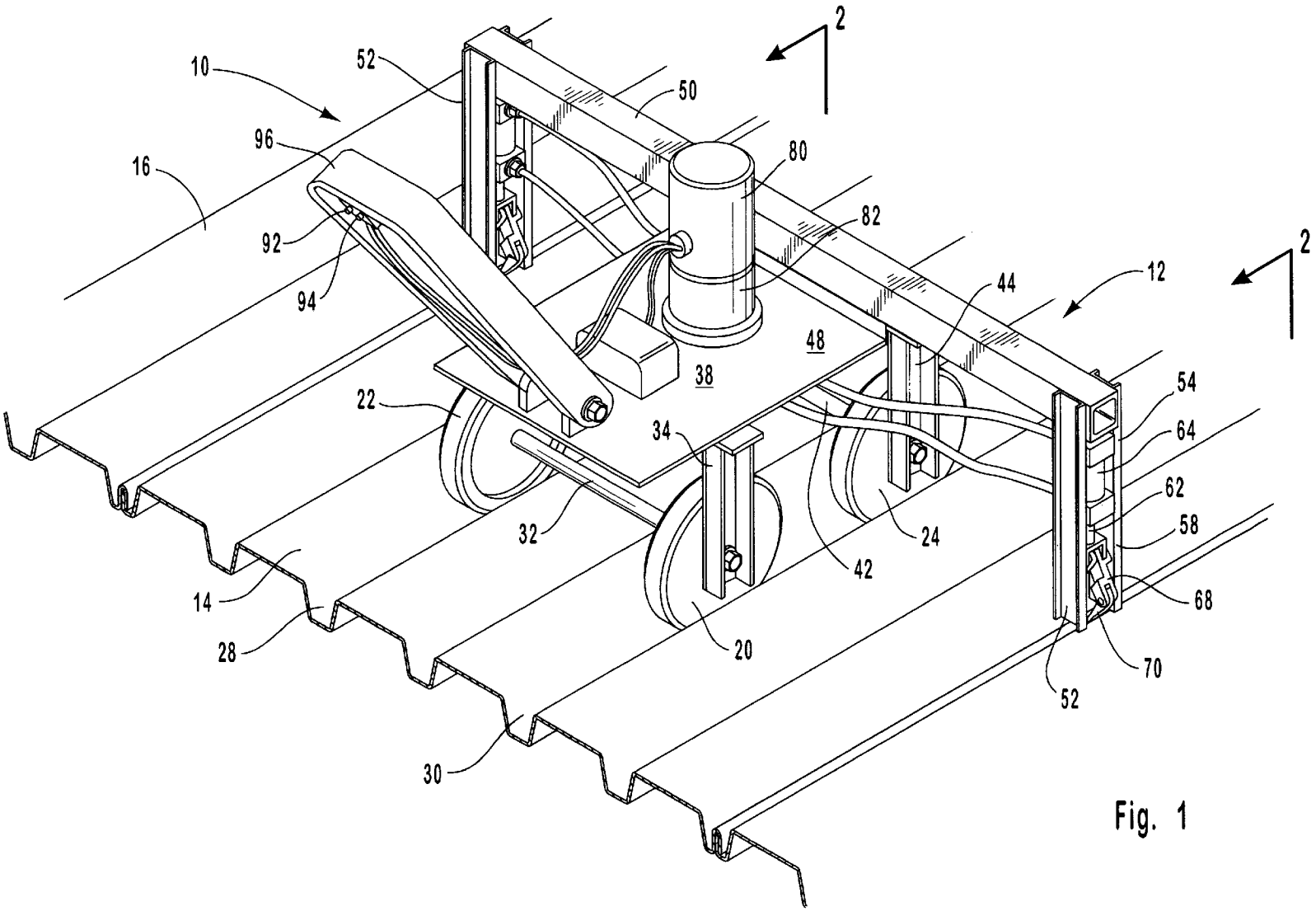

This invention relates to tools used to crimp together overlapping flanges of the galvanized steel decking often found in steel buildings.

BACKGROUND OF THE INVENTION

Steel decking is commonly used to form floors and roofs of buildings. The decking generally consists of sheets of steel formed with elongate grooves separated by elongate bridges. Adjacent sheets have parallel side edges, with one side edge turned upwardly within a common side edge groove and with the other side edge turned upwardly and then turned back so that the edge is downturned to fit over the upwardly turned side edge of an adjacent sheet and to form a locking seam centrally positioned within the common groove formed between adjacent sheets of steel.

PRIOR ART

For most installations, hand held crimping pliers are manually operated to crimp the turned back edge of a steel decking sheet to an upwardly extending side of an adjacent steel decking sheet. Crimping is done at spaced intervals along the length of the locking seam, with the number of crimps, the lengths of the crimps and the pressure applied during crimping determining the quality of the completed floor or roof. It is not uncommon for a workman to initially make good crimps using the available crimping pliers, but, as the job proceeds and the workman tires or blisters form on his hands, he becomes unable to continue to apply sufficient pressure through the pliers necessary to make good quality, sufficiently long crimps or to continue to make closely spaced crimps. Failure to make good quality crimps can result in a building deck, floor or roof incapable of withstanding design stresses, sometimes with a resultant loss of the structure and possibly injury to people.

At the present time it is also common for a welder to apply a weld to the top of each of the crimps This further prevents separation of the crimps and greatly increase the strength of the structure. However, if the crimps are not made tight, the weld applied to the top of the crimp may not uniformly weld the sheets together and the welds may shear. Consequently, it is very important in the placing of the sheets of a steel decking that tight crimps be formed.

OBJECTS OF THE INVENTION

It is a principal object of the present invention to provide a hydraulically operated tool that is easily used to crimp together adjacent steel sheets of a deck. Another object is to provide a tool capable of making simultaneous crimps along a plurality of locking seams formed between adjacent steel decking sheets of a deck, floor or roof, or the like, thereby providing cost savings over the known process of crimping individual seams, by hand.

Other objects are to provide a tool that will make uniformly tight crimps of uniform length, thereby providing a satisfactory weld surface on the top of each crimp.

FEATURES OF THE INVENTION

Principal features of the invention include a handle controlled support plate carried by wheels spaced apart to travel in central grooves formed in a steel decking sheet. An outrigger arm is carried by a leading edge of the support plate and must extend beyond both side edges of the support plate. A hydraulically operated pinch clamp is carried by each of the ends of the outrigger arm and each pinch clamp travels along and extends onto a locking seam that is formed by interlocking edges of adjacent decking sheets within a common groove formed by the adjacent decking sheets.

Control valves regulate liquid flow to the pinch clamps and may be operated to have only one pinch clamp operational or to have both pinch clamps operated simultaneously.

Additional objects and features of the invention will become apparent to those skilled in the art to which the invention pertains, from the following detailed description and drawings.

THE DRAWINGS

Figure 2:
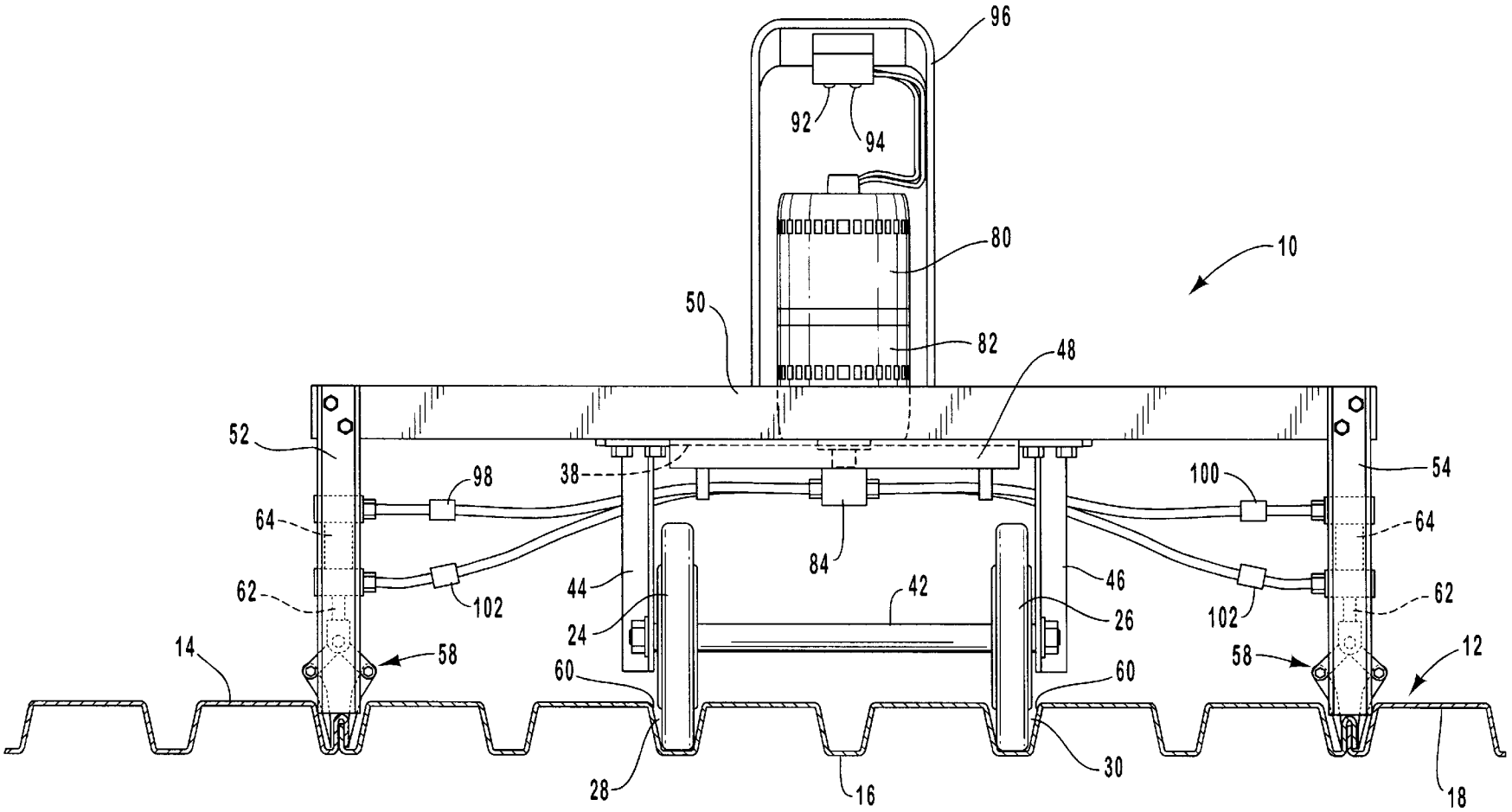
Figure 3:
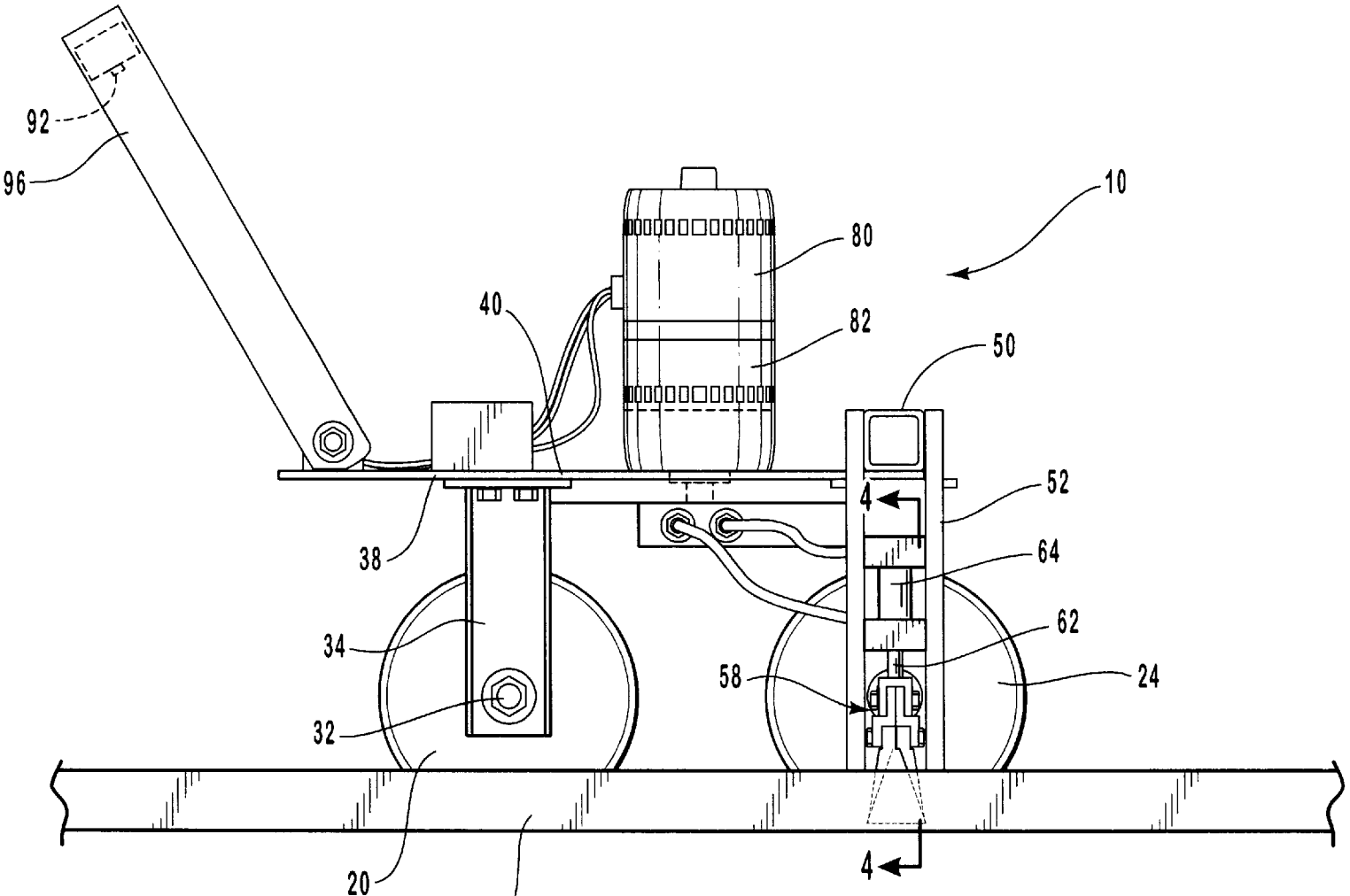
Figure 4:
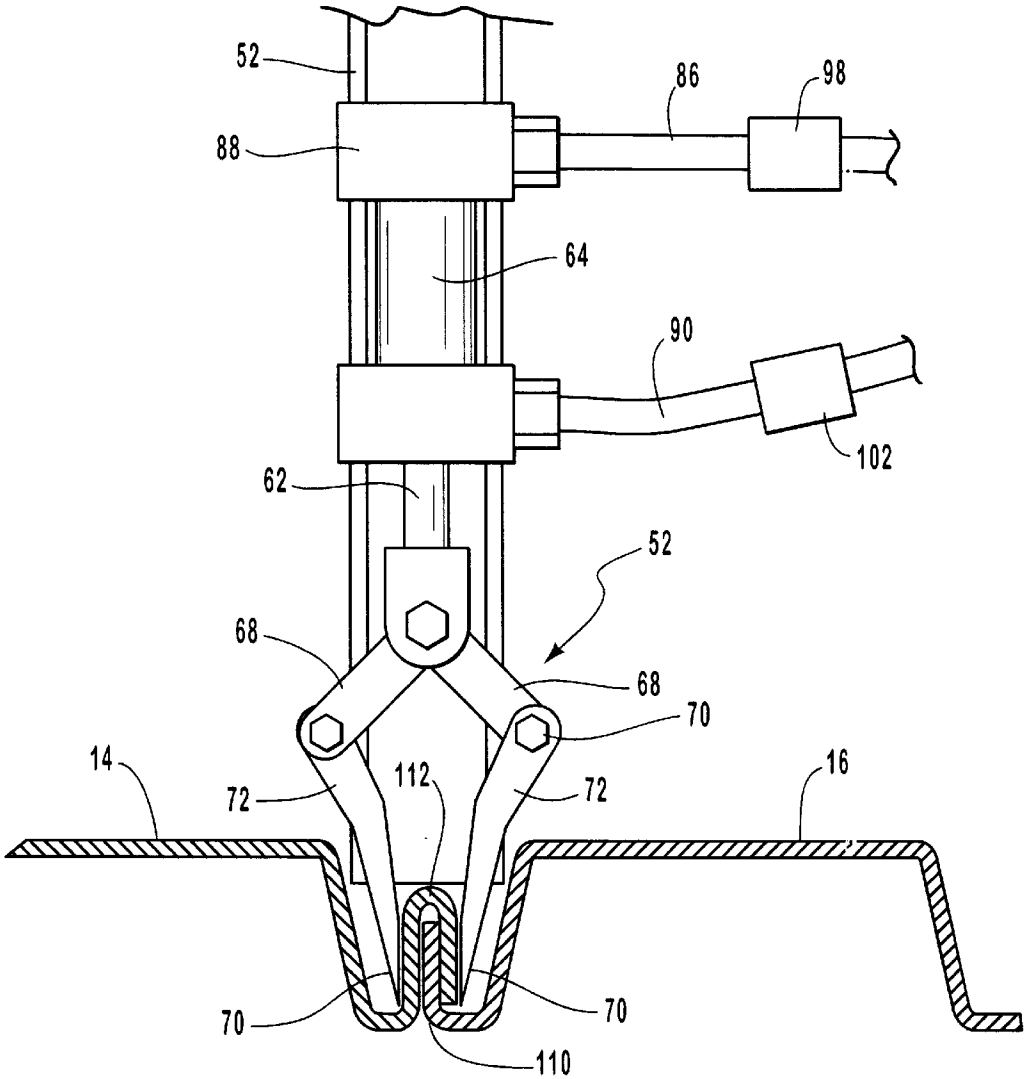
Figure 5:
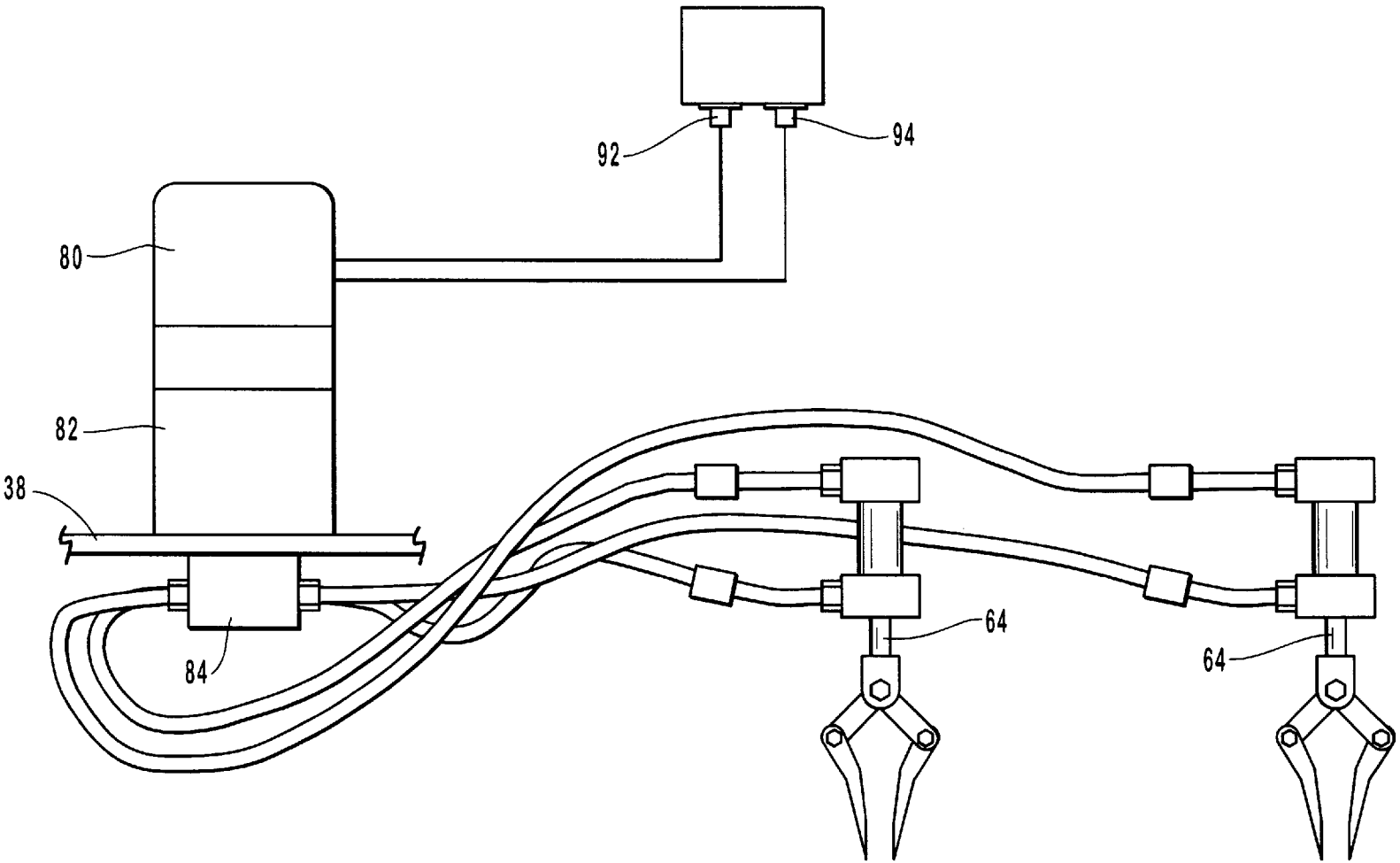

In the drawings:

FIG. 1, a pictorial view, showing the hydraulic deck crimper of the invention on a steel deck;

FIG. 2, a front elevation view;

FIG. 3, a side elevation view;

FIG. 4, an enlarged view, taken within the line 4—4 of FIG. 3 and showing a pinch clamp; and FIG. 5, a schematic diagram of the hydraulic and electric circuits of the invention.

DETAILED DESCRIPTION

Referring now to the drawings:

In the illustrated preferred embodiment of the invention the hydraulic deck crimper of the invention is shown generally at 10, positioned on a steel deck 12 made up of overlapping panels 14, 16, and 18. Wheels 20, 22, 24, and 26 of the crimper 12 are shown in central grooves 28 and 30 of the panel 14 and 16. Wheels 20 and 22 are mounted on opposite ends of an axle 32 that is journaled through lower ends of legs 34 and 36 that depend from opposite sides at the rear 38 of a support plate 40. Similarly, wheels 24 and 26 are mounted on opposite ends of an axle 42 that is journaled through lower ends of legs 44 and 46 that depend from opposite sides and the front 48 of the support plate 38. Wheels 20 and 24 are aligned and, as shown, are positioned to travel in central groove 28 of deck 12 and wheels 22 and 26 are aligned and, as shown, are positioned to travel in central groove 30 of deck 12.

An outrigger arm 50 is fixed to and extends transversely across and as an extension means beyond each side of the front 48 of the support plate 38. Channel members 52 and 54 are respectively fixed to and depend from opposite ends of the outrigger arm 50. The channel members are spaced apart such that a pinch clamp 58 carried by and mounted within each channel member will have a tip end 60 positioned centrally within an outer groove common to the panel in which wheels 20, 22, 24, and 26 are positioned to travel in central grooves of the panel and an adjacent panel.

Each pinch clamp 58 is connected to a rod 62 of a hydraulic cylinder 64, also mounted in and carried by a channel member 52 or 54. Expulsion of the rod 62 from the cylinder 64 forces the ends 66 of oppositely acting links 68 that are remote from the pivotal connections of the links to the rods 62 outwardly and down. At the same time the crimping ends 70 of arms 72 that are pivotally connected to the ends 74 of links 68 are moved inwardly towards one another, thereby applying a pinching action. The tips 74 of the crimping ends are elongate and sufficiently long to provide a crimp of suitable length. A two inch long crimp has been found suitable, for example, in many operations.

An electric motor 80 is mounted on the support plate 38 to drive a hydraulic pump 82, having a hydraulic reservoir 84. A supply hose 86 connects the pump with one end 88 of each hydraulic cylinder and a return hose 90 connects the other end of the cylinder to the hydraulic reservoir.

A switch 92, shown mounted on a handle 96 that is centrally fixed to and projects upwardly and rearwardly of the support plate 38 controls power to the electric motor 80 and another switch 94, also mounted on the handle 96, controls valves 98 and 100, respectively controlling flow through the supply hoses 86 and valves 102 and 104 controlling flow through the return hoses 90. Switch 94 will actuate either of the valves 98 or 100 to allow hydraulic fluid from pump 82 to expel a rod 62 or to expel both rods 62 simultaneously. At the same time, switch 94 will open valves 102 to allow flow from the opposite ends of the cylinders into the reservoir. Positioning of switch 94 to a release position will reverse flow into the cylinders, thereby retracting each previously expelled rod 62 of the cylinders 64.

Each time a rod 62 is expelled a pinching action takes place at the tip end 60 of a pinch clamp 58. The pinching action then securely crimps together mating flanges of adjacent sheets of the deck 12.

The mating flanges of adjacent panels include an upturned flange 110 at the outer edge of one panel and an overlapping flange 112 on an outer edge of the connecting panel. Pinching and subsequent welding of portions of the mating flanges, which are centrally located within a groove formed by the edges of adjacent panels, securely locks the panels together.

While a preferred embodiment of the invention has been herein disclosed and described, it is to be understood that the scope of the invention is to be proscribed only by the following claims, which claims define my invention.

I claim:

1. A hydraulic deck crimper comprising a support plate;

a plurality of legs projecting from said support plate;

a wheel mounted to an end of each leg at the ends of said legs remote from said support plate;

extension means projecting from a front edge of said support plate beyond opposite sides of said support plate;

a hydraulic cylinder fixed to and projecting downwardly from said extension means at each side of said support plate and having a rod extensible from and retractable into said cylinder; and a pinch clamp connected to each said rod, each said pinch clamp including arms having tips at ends remote from said hydraulic cylinder and said tips being forced together upon actuation of said hydraulic cylinder and each pinch clamp including a pair of arms, each arm having one end pivotally connected to a rod and an opposite end pivotally connected to a link and having a pinch end remote from said pivot connection.

2. A hydraulic deck crimper as in claim 6, wherein each pinch end is elongate to provide a pinching surface having a desired predetermined length.

3. A hydraulic deck crimper as in claim 4, further including a reservoir;

an electric motor;

a pump powered by said electric motor and carried by said support plate; and valve means to control flow through said pump to each said cylinder and from each said cylinder to said reservoir, whereby each pinch clamp is independently operated and said pinch clamps are simultaneously operable.

4. A hydraulic deck crimper comprising a support plate;

a plurality of legs projecting from said support plate;

a wheel mounted to an end of each leg at the ends of the legs remote from said support plate;

extension means projecting from a front edge of said support plate beyond at least one side edge of said support plate;

a hydraulic cylinder fixed to and projecting downwardly from said extension means adjacent at least one side of said support plate and having a rod extensible from and retractable into said cylinder;

a pinch clamp connected to said rod, said pinch clamp including arms having tips at ends remote from said hydraulic cylinder and said tips being forced together upon actuation of said hydraulic cylinder; and each pinch clamp including a pair of arms, each arm having one end pivotally connected to a rod and an opposite end pivotally connected to a link and having a pinch end remote from said pivot connection.

5. A hydraulic deck crimper as in claim 4, wherein each pinch end is elongate to provide a pinching surface having a desired predetermined length.

6. A hydraulic deck crimper as in claim 5, further including a reservoir;

an electric motor;

a pump powered by said electric motor and carried by said support plate; and valve means to control flow through said pump to each said cylinder and from each said cylinder to said reservoir, whereby each pinch clamp is independently operated and said pinch clamps are simultaneously operable.

* * * * *